US007013494B2

(12) United States Patent
Wilkins

(10) Patent No.: US 7,013,494 B2
(45) Date of Patent: Mar. 21, 2006

(54) HANDKERCHIEF WITH POUCH

(76) Inventor: Warren Wilkins, 21635 Brookside Ct., Walnut, CA (US) 91789

( * ) Notice: Subject to any disclaimer, the term of this patent is extended or adjusted under 35 U.S.C. 154(b) by 0 days.

(21) Appl. No.: 10/772,551

(22) Filed: Feb. 4, 2004

(65) Prior Publication Data

US 2004/0154077 A1 Aug. 12, 2004

Related U.S. Application Data

(60) Provisional application No. 60/445,597, filed on Feb. 6, 2003.

(51) Int. Cl.
*A41B 15/00* (2006.01)

(52) U.S. Cl. ..... 2/279
(58) Field of Classification Search ..... 2/279, 2/247, 49.2, 49.1, 49.4, 207
See application file for complete search history.

(56) References Cited

U.S. PATENT DOCUMENTS

| | | | | |
|---|---|---|---|---|
| 2,006,708 | A * | 7/1935 | Benedict | 401/201 |
| 2,119,895 | A * | 6/1938 | Sutton | 401/201 |
| 3,105,970 | A * | 10/1963 | Cecile | 2/91 |
| 3,871,027 | A * | 3/1975 | Orr | 2/49.2 |
| 4,467,503 | A * | 8/1984 | Boynton | 24/7 |
| 4,646,365 | A * | 3/1987 | Suprise et al. | 2/49.2 |
| 4,706,303 | A * | 11/1987 | Van Gompel et al. | 2/49.2 |
| 5,326,610 | A * | 7/1994 | Moss | 428/78 |
| 5,797,142 | A * | 8/1998 | Debronsky et al. | 2/69 |
| 6,256,788 | B1 * | 7/2001 | Loewer et al. | 2/49.2 |
| 6,282,716 | B1 * | 9/2001 | Patterson et al. | 2/49.1 |

* cited by examiner

*Primary Examiner*—Gary L. Welch
(74) *Attorney, Agent, or Firm*—Denton L. Anderson; Sheldon & Mak

(57) ABSTRACT

A handkerchief has a base layer of soft, absorbent material and a pouch layer of soft, absorbent material. The area of the pouch layer is less than the area of the base layer. The pouch layer is attached to the base layer so as to form an enclosed pouch having a single access opening.

13 Claims, 1 Drawing Sheet

HANDKERCHIEF WITH POUCH

RELATED APPLICATIONS

This application is a continuation-in-part of U.S. Provisional Application Ser. No. 60/445,597, filed Feb. 6, 2003, entitled SNEEZE STOPPER TISSUE/HANDKERCHIEF, the entirety of which is incorporated herein by this reference.

FIELD OF THE INVENTION

This invention relates generally to cloth and paper handkerchiefs.

BACKGROUND OF THE INVENTION

Handkerchiefs, typically made from a cloth material, have been in use for many thousands of years. In the twentieth century, handkerchiefs made from soft paper, typically termed "tissues," have also been in common use.

Handkerchiefs have traditionally been merely two-dimensional devices. Because a traditional handkerchief is only two-dimensional, solid particles and liquid droplets can escape from the handkerchief during use in catching a sneeze or cough from a user or during the blowing of the nose of the user. Any such escapes from the handkerchief is both embarrassing to the user and poses a health risk to those in the user's vicinity.

Accordingly, there is a need for a handkerchief which avoids the aforementioned problems in the prior art—in an inexpensive and efficient manner.

SUMMARY OF THE INVENTION

The invention satisfies this need. The invention is a handkerchief comprising (a) a base layer of soft, absorbent material, the base layer having a pair of opposed sides, both of which define a base layer area between about 9 square inches and about 576 square inches; and (b) a pouch layer of soft absorbent material attached to the base layer so as to define a pouch enclosure with a single pouch enclosure opening, the pouch layer having a pair of opposed sides, both of which define a pouch layer area less than that of the base layer area.

DESCRIPTION OF THE DRAWINGS

These and other features, aspects and advantages of the present invention will become better understood with reference to the following description, appended claims and accompanying drawings where:

DETAILED DESCRIPTION

Figure 1:
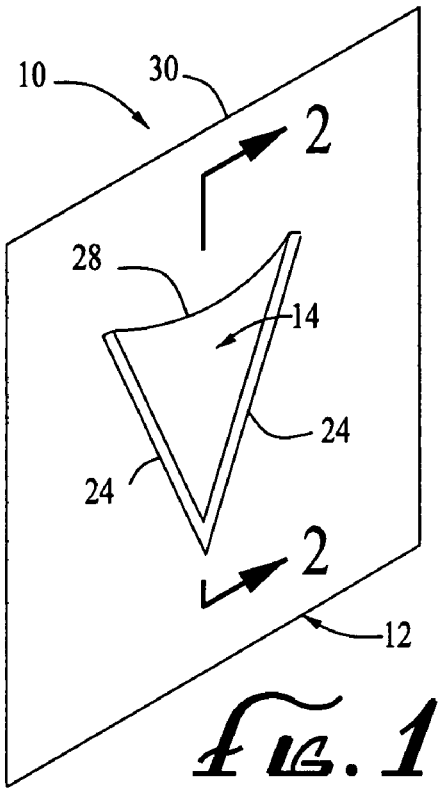
FIG. 1 is a perspective view of a first handkerchief having features of the invention.

The following discussion describes in detail one embodiment of the invention and several variations of that embodiment. This discussion should not be construed, however, as limiting the invention to those particular embodiments. Practitioners skilled in the art will recognize numerous other embodiments as well.

The invention is a handkerchief 10 comprising a base layer 12 and a pouch layer 14. The base layer 12 is made of a soft absorbent material, such as a soft woven cloth, soft non-woven cloth or soft paper. In one embodiment of the invention, the base layer 12 is made of a linen cloth material. In another embodiment, the base layer 12 is made of a cellulose pulp paper material, such as the material used to make paper tissue handkerchiefs 10.

The base layer 12 is typically square in shape, although other shapes can also be used. The base layer 12 is also typically of similar size as traditional one-layer handkerchiefs 10 of the prior art. The base layer 12 has a front surface 16 and a rear surface 18, both of which define a base layer area between about 9 square inches and about 576 square inches, typically between about 25 square inches and about 400 square inches.

The pouch layer 14 is also made from a soft, absorbent material, typically from the same soft, absorbent material used in the base layer 12. In the usual case, the thickness of the pouch layer 14 is about the same as the thickness of the base layer 12. In some embodiments, however, the thickness of the pouch layer 14 is greater than the thickness of the base layer 12, so that the pouch layer 14 is considered to be "padded," and in other embodiments, the thickness of the pouch layer 14 is less than the thickness of the base layer 12, so that the base layer 12 is considered to be "padded."

The pouch layer 14 has a front surface 20 and a rear surface 22, both of which define a pouch layer 14 area less than that of the base layer area. The pouch layer 14 area is generally between about 1 square inch and about 64 square inches, typically between about 4 square inches and about 36 square inches.

Figure 2:
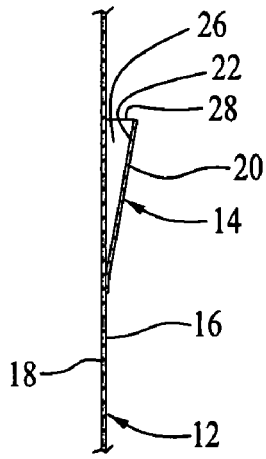
FIG. 2 is a cross-sectional side view of the handkerchief illustrated in FIG. 1, taken along line 2—2.
Figure 3:
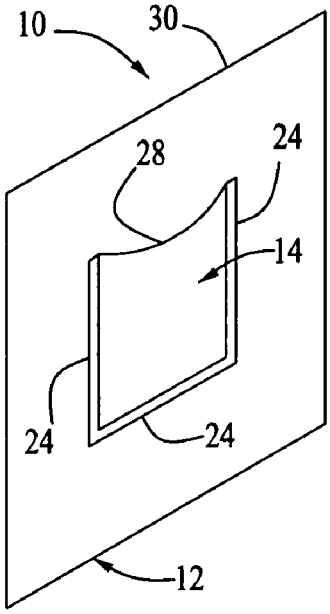
FIG. 3 is a perspective view of a second handkerchief having features of the invention.
Figure 4:
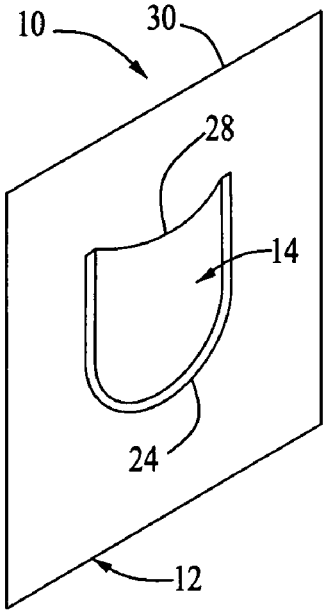
FIG. 4 is a perspective view of a third handkerchief having features of the invention.
Figure 5:
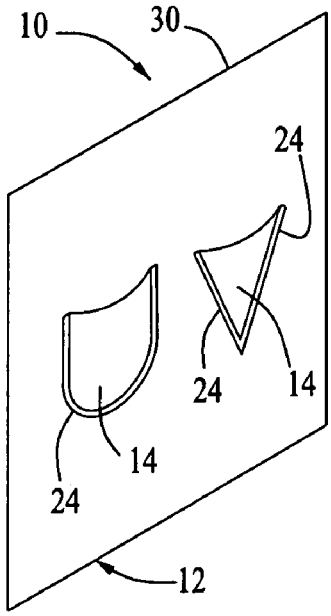
FIG. 5 is a perspective view of a fourth handkerchief having features of the invention.

The pouch layer 14 is typically rectangular or U-shaped. Many other shapes can also be used. FIGS. 1 and 5 illustrate pouch layers 14 which are V-shaped. FIG. 2 illustrates a pouch layer 14 which is rectangular. FIGS. 4 and 5 illustrate pouch layers 14 which are U-shaped.

The pouch layer 14 is attached to the base layer 12 along attachment edges 24, so as to define a pouch enclosure 26 with a single pouch enclosure opening 28. Any suitable method for attaching the attachment edges 24 of the pouch layer 14 to the base layer 12 can be used. Where the base layer 12 and the pouch layer 14 are made of a cloth material, the pouch layer 14 can be sewn to the base layer 12 or it can be attached to the base layer 12 by a suitable adhesive. Where the pouch layer 14 and the base layer 12 are made of paper, such as cellulose pulp, the pouch layer 14 can also be attached to the base layer 12 by sewing, but more commonly, it is attached to the base layer 12 by pressure attachment or by a suitable adhesive. Also, for embodiments made from non-woven cloth and paper, it is possible to mold the base layer 12 and the pouch layer 14 as a one-piece, integral unit.

The pouch layer 14 can be attached to the base layer 12 such that the pouch layer 14 lies relatively flat against the base layer 12. In other embodiments, however, the pouch layer 14 can be provided with additional material so that the pouch layer 14 does not generally lay flat against the base layer 12.

The width of the pouch enclosure 26 opening is sized and dimensioned to conveniently allow the user to blow his or her nose into the pouch or to use the pouch to catch a sneeze or cough. In most cases, the width of the pouch enclosure opening 28 will be between about 2 inches and about 8 inches, usually between about 2½ inches and about 6 inches.

Typically, the upper edge 30 of the base layer 12 is generally linear and the pouch enclosure opening 28 is disposed between about 1 inch and about 5 inches below the upper edge 30 of the base layer 12, most typically between about 2 inches and about 4 inches below the upper edge 30 of the base layer 12.

Also typically, the pouch enclosure 26 extends downwardly below the pouch enclosure opening 28 by a distance of between about 1 inch and about 8 inches, most typically between about 2 inches and about 5 inches.

The invention provides for an improved handkerchief which prevents the inadvertent emission of solid particles or liquid droplets during use of the handkerchief to catch a sneeze or a cough or in blowing the user's nose. The invention is simple and inexpensive to construct and use.

Having thus described the invention, it should be apparent that numerous structural modifications and adaptations may be resorted to without departing from the scope and fair meaning of the instant invention as set forth hereinabove and as described hereinbelow by the claims.

What is claimed is:

1. A method of catching and retaining solid particles and liquid droplets expelled from a cough, sneeze or nose blow, the method comprising the steps of:

(a) providing a handkerchief comprising:

(i) a base layer of soft, absorbent material, the base layer having a pair of opposed sides, both of which define a base layer area between about 9 square inches and about 576 square inches; and (ii) a pouch layer of soft absorbent material attached to the base layer so as to define a pouch enclosure with a single pouch enclosure opening, the pouch layer having a pair of opposed sides, both of which define a pouch layer area less than that of the base layer area; and (b) catching and retaining expelled solid particles and liquid droplets from a cough, sneeze or nose blow in the pouch enclosure.

2. The method of claim 1 wherein the base layer area is between about 25 square inches and about 400 square inches.

3. The method of claim 1 wherein the pouch layer area is between about 4 square inches and about 36 square inches.

4. The method of claim 1 wherein the pouch enclosure is V-shaped.

5. The method of claim 1 wherein the pouch enclosure is U-shaped.

6. The method of claim 1 wherein the pouch enclosure is rectangular.

7. The method of claim 1 wherein two separate pouch layers of soft absorbent material are attached to the base layer side by side so as to define a pair of side by side pouch enclosures, each with a single pouch enclosure opening, both pouch layers having a pair of opposed sides, the pair of opposed sides both defining a pouch layer area less than that of the base layer area.

8. The method of claim 1 wherein the base layer comprises a generally linear upper edge, the pouch enclosure opening is disposed between about 2 inches and about 4 inches below the upper edge of the base layer.

9. The method of claim 1 wherein the pouch extends downwardly below the pouch enclosure opening a distance of between about 2 inches and about 5 inches.

10. The method of claim 1 wherein the pouch layer is thicker than the base layer.

11. The method of claim 1 wherein the pouch layer is thinner than the base layer.

12. The method of claim 1 wherein both the base layer and the pouch layer are made of a soft absorbent linen cloth material.

13. The method of claim 1 wherein both the base layer and the pouch layer are made of a soft absorbent paper material.

* * * * *